US005402840A

United States Patent [19]

Jortner et al.

[11] Patent Number: 5,402,840

[45] Date of Patent: Apr. 4, 1995

[54] VENETIAN BLIND TILT DIVIDER

[76] Inventors: Aaron Jortner, 2401 Brennan Dr., Plano, Tex. 75075; John F. Bryan, Jr., 3510 Woodcreek Cir., Parker, Tex. 75002

[21] Appl. No.: 180,870

[22] Filed: Jan. 12, 1994

[51] Int. Cl.[6] ..... E06B 3/48

[52] U.S. Cl. ..... 160/115; 160/177; 24/136 R; 24/136 K; 24/171; 24/130116 R

[58] Field of Search ..... 160/115, 176.1, 177, 160/178.1; 24/136 R, 136 K, 129 A, 171, 197, 73.1, 130, 16 R

[56] References Cited

U.S. PATENT DOCUMENTS

| | | | |
|---|---|---|---|
| 441,757 | 12/1890 | Gardner | 24/136 K |
| 839,311 | 12/1906 | Nerean-Hutchison | 24/71.3 |
| 1,365,919 | 1/1921 | Jones | 160/115 |
| 2,296,010 | 9/1942 | Balthasar | 160/115 |
| 2,299,701 | 10/1942 | Mitchell | 160/115 |
| 2,311,792 | 2/1943 | Valkenburgh | 24/71.3 |
| 2,894,574 | 7/1959 | Micciche | 160/115 |
| 4,621,672 | 11/1986 | Hsu | 160/115 |
| 4,947,921 | 8/1990 | Chun-Cheng | 160/176.1 |
| 5,119,868 | 6/1992 | Werner | 160/115 |

FOREIGN PATENT DOCUMENTS

| | | | |
|---|---|---|---|
| 1342 | 1/1907 | United Kingdom | 160/115 |

OTHER PUBLICATIONS

Sales Literature by Jag Corp. of Tulsa OK "Privacy Options" (Both Sides of Single Page).

*Primary Examiner*—Blair M. Johnson
*Attorney, Agent, or Firm*—John F. Bryan

[57] ABSTRACT

The slats of a venetian blind are divided into upper and lower portions by the installation of a divider, comprising a spacer and a retainer, which serve to shorten the working length of the tilt adjusting ladders on either the inside or outside of the blind, altering the tilt of the slats of the lower portion so as to be more closed or more open with respect to the slats of the upper portion, depending upon the adjustment of the tilt control ladder.

12 Claims, 6 Drawing Sheets

VENETIAN BLIND TILT DIVIDER

This is a continuation-in-part of application Ser. No. 08/072,552, filed on Jun. 7, 1993, now abandoned.

FIELD OF THE INVENTION

The present invention relates to venetian blinds, and more particularly, to an apparatus allowing louver tilt, in selected portions of any such blind, to be separately adjusted as the user desires.

BACKGROUND AND SUMMARY OF THE INVENTION

Venetian blinds, with an adjustable opening mode having more flexibility than the roller type window shade, have long been accepted for window covering. They are commonly made in the form of mini-blinds, with 1" wide slats, which have become the single most popular such device. With the exception of several rather complex and consequently expensive variants, the adjustment of slat angle in venetian blinds is uniform from top to bottom. While this is tolerable, considering the overall ease of use, a more selective adjustment control is desirable. It would be appreciated if the user could block the lower portion of the blind for privacy while leaving the top portion open for light or, to the opposite, open the lower portion for a better view while closing the upper portion to a morning or afternoon sun.

It is the object of the present invention to accomplish such control in an inexpensive manner and furthermore, in a manner which can be applied to virtually any venetian type blind. A further object is to make the installation of such control readily removable so that the blind can be restored to normal operation at any time the user should wish.

These objects are met in the present invention by shortening the slat tilt control ladder between upper and lower portions of the slat array so that the lower slats are tilted to an open position while the upper slats are more or less closed closed. With the tilt of the slat members biased in this manner, closing the lower slats tilts the upper slats to an open position. Intermediate positions adapt the blind to varied lighting conditions and are also useful.

DESCRIPTION OF THE DRAWINGS

The foregoing and other objects and features of the invention will be apparent from the following detailed description of specific embodiments thereof, when read in conjunction with the accompanying drawings, in which.

DETAILED DESCRIPTION OF THE PREFERRED EMBODIMENTS

Figure 1:
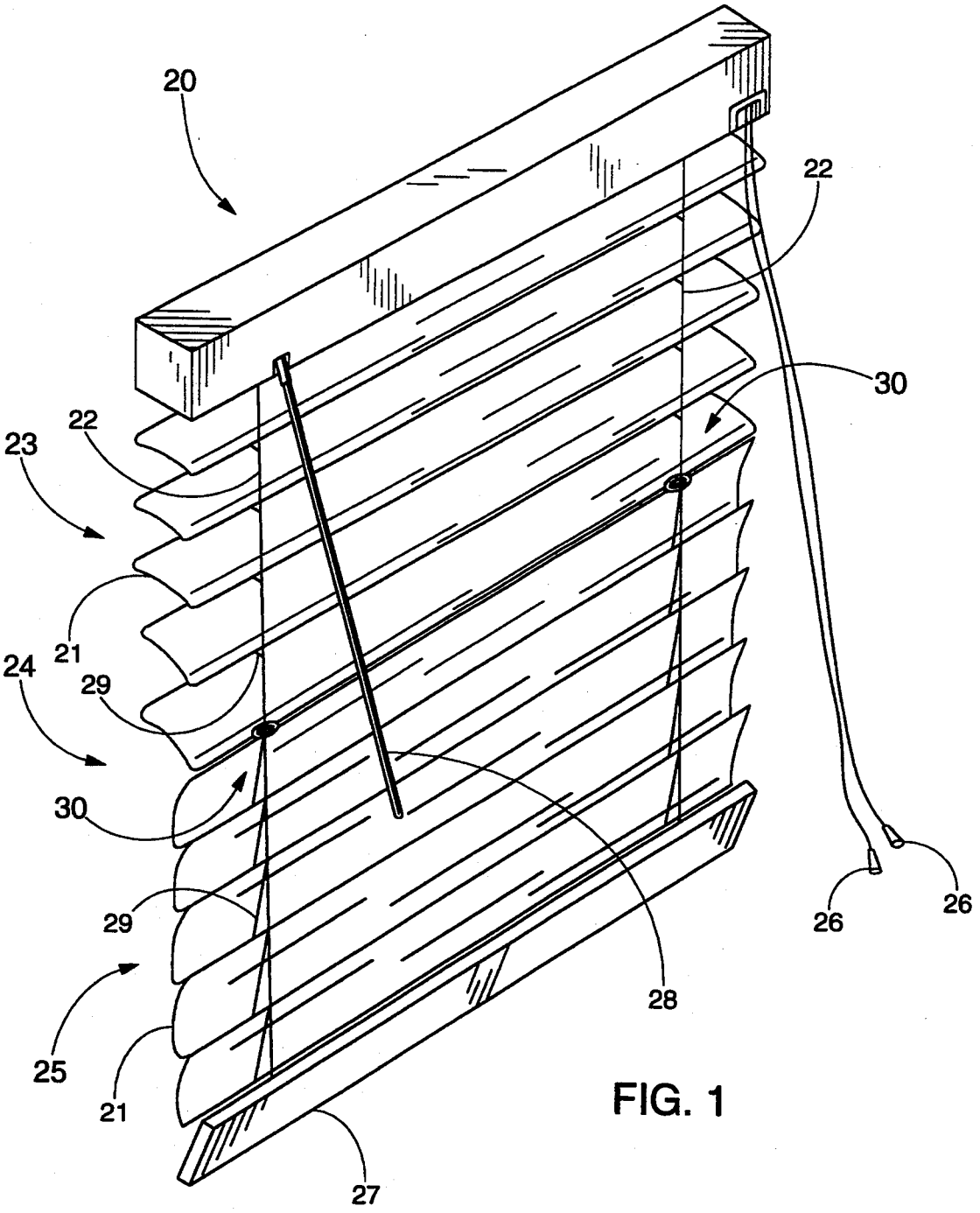
FIG. 1 is an overall view of a blind with the present invention installed.

Turning now to FIG. 1, there is seen a typical venetian blind 20, unmodified except for installation of tilt divider 30 of the present invention in each of two tilt control cord ladders 22. This installation arbitrarily divides the vertical array 24 of slats 21 into upper portion 23 and lower portion 25. Control cords 26 raise or lower weighted bottom member 27 to adjust and hold the height of vertical array 24, a function unrelated to this invention and hence, neither shown in detail nor discussed. Tilt control wand 28 is rotated to vary the inclination of slat support cords 29 of tilt control ladder 22 and thus, to adjust the tilt of slats 21.

Figure 2:
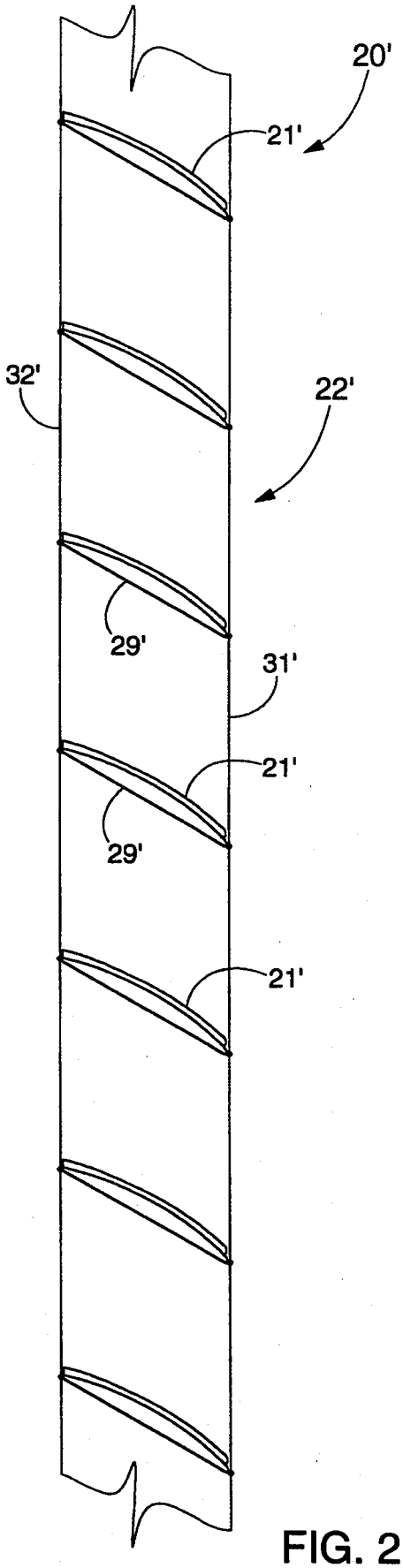
FIG. 2 is a section of a conventional venetian blind showing an adjustment of the tilt control ladder.

FIG. 2 is an end view of the venetian blind 20', the blind 20 of FIG. 1, prior to the installation of tilt divider 30. Here, tilt control ladder 22' is seen to include inside vertical cord 31' and outside vertical cord 32' interconnected by uniformly spaced slat support cords 29'. Slats 21' are thereby supported at a uniform angle of inclination which is adjusted by raising or lowering vertical cords 31' and 32' relative to one another. The range of this relative movement is somewhat less than twice the width of slat 21'.

Figure 3:
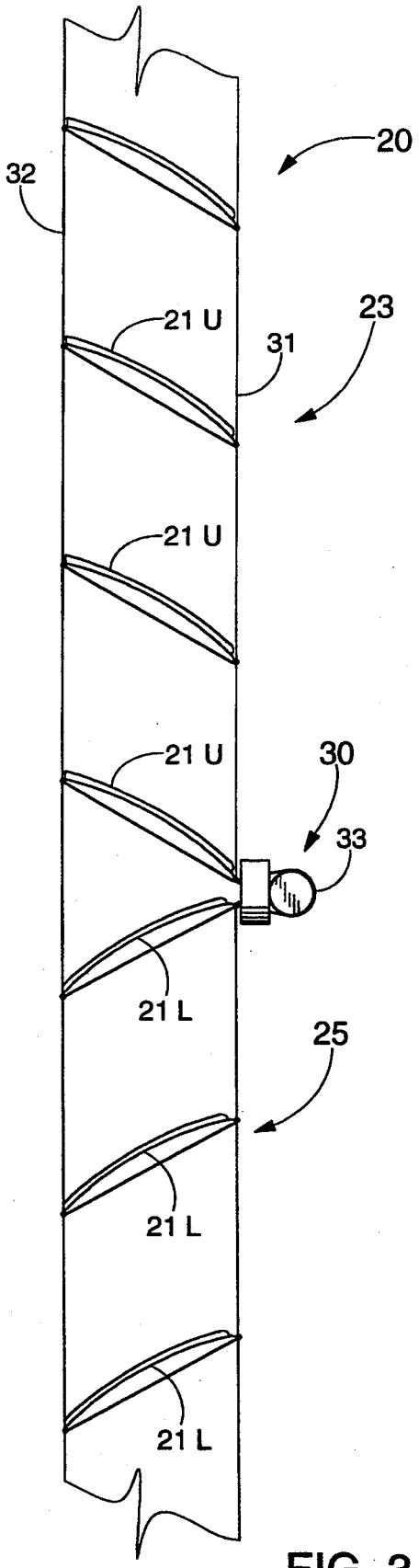
FIG. 3 a section of a conventional venetian blind which illustrates shortening of the tilt control ladder by use of the present invention.

FIG. 3 is an end view of venetian blind 20 of FIG. 1, with the installation of tilt divider 30, which may be in either inside vertical cord 31 or outside vertical cord 32 with slightly different but similar results. As shown here, a loop 33 of vertical cord 31 is taken up by tilt divider 30, at a location between slats 21U and 21L. The manner of installation is described below in greater detail but, it is clearly seen that the effect is to change the tilt of all slats 21L similarly, to an angle which is appreciably different from the tilt of slats 21U.

Figure 4:
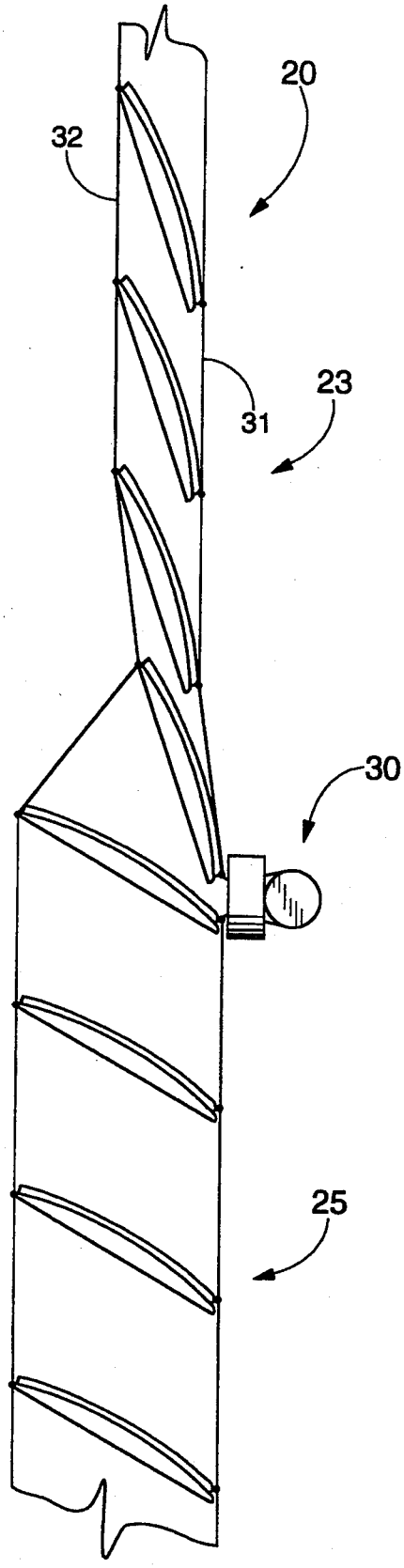
FIG. 4 shows the blind of FIG. 3 with the tilt control ladder adjusted so as to fully close slats in the upper portion.
Figure 5:
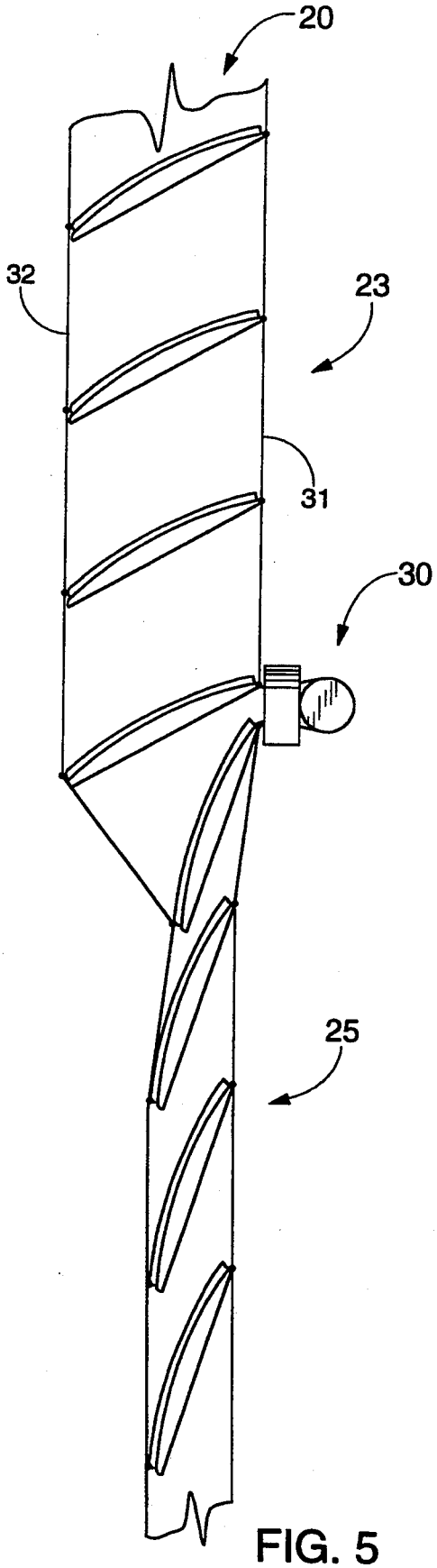
FIG. 5 shows the blind of FIG. 3 with the tilt control ladder adjusted so as to fully close slats in the lower portion.

FIG. 4 shows the venetian blind 20 of FIG. 1 and FIG. 3 as it appears with vertical cord 31 adjusted to its lowermost position relative to vertical cord 32. In this manner, the lower portion 25 is open while upper portion 23 is fully closed. FIG. 5 shows the extreme opposite adjustment, with lower portion 25 fully closed and upper portion 23 in an open position. A full range of intermediate positions are also available to the user.

Figure 6:
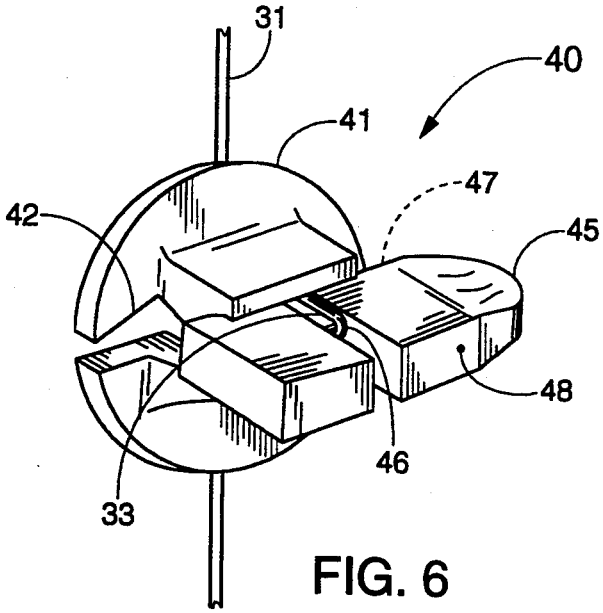
FIG. 6 shows a preferred embodiment of the invention.
Figure 7:
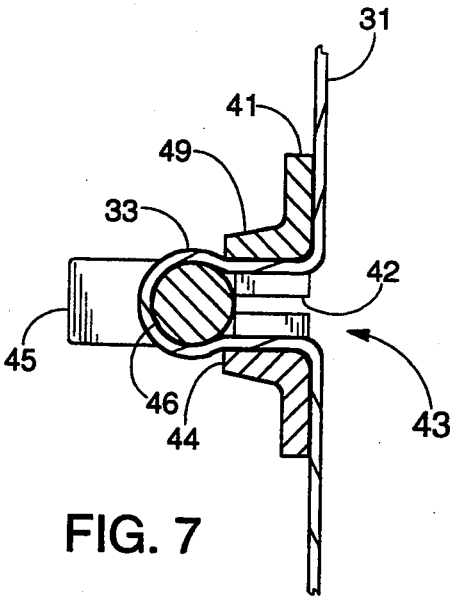
FIG. 7 is a section view of the preferred embodiment of the invention in a first position.
Figure 9:
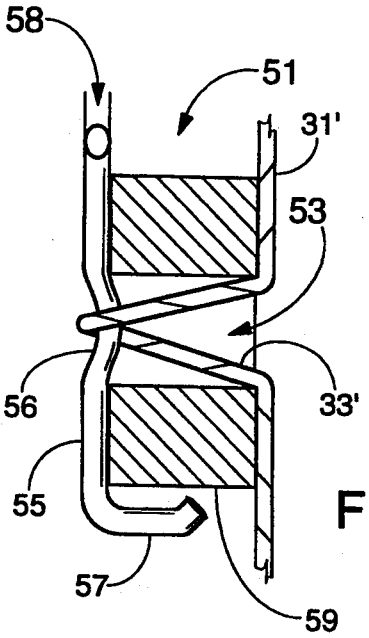
FIG. 9 shows a second preferred embodiment of the invention.
Figure 8:
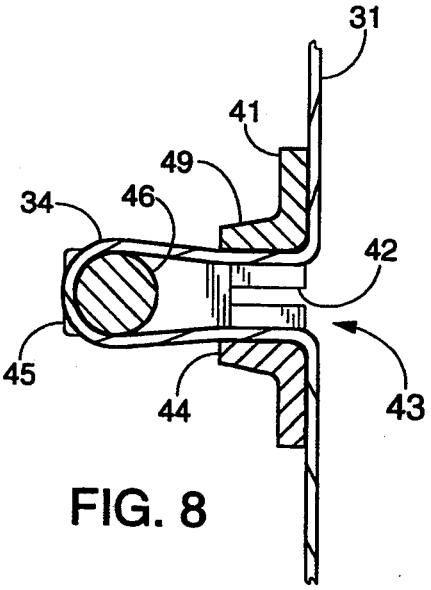
FIG. 8 is a section view of the preferred embodiment of the invention in a second position.

FIGS. 6, 7 and 8 show a preferred embodiment 40 of tilt divider 30 which is now seen to comprise retainer 45 and a spacer 41, which has a wall 49 and an open center 43. Loop 33 of vertical cord 31 is passed through opening 42 in wall 49, which may be contoured as shown to aid the capture of vertical cord 32. Loop 33 passes into the open center 43 of spacer 41 and is held by the offset section 46 of retainer 45. Tension on vertical cord 31 and loop 33 then seats side 47 of retainer 45 in a transverse position against contoured end surface 44 of spacer wall 49. Contoured end surface 44 holds retainer 45 in position and loop 33 shortens the working length of vertical cord 31. as is shown in FIG. 7 so as to somewhat alter the tilt of slats 21 in lower portion 25. Should retainer 45 be turned over, as is shown in FIG. 8, placing side 48 against contoured end surface 44, offset section 46 is held in position to retain the longer loop 34. Longer loop 34 provides the option of a second, more pronounced alteration of tilt of slats 21 in lower portion 25. Thus, referring to FIG. 1, upper portion 23 of venetian blind 20 and lower portion 25 are more or less oppositely adjusted for either light or privacy. FIG. 9 shows a second preferred embodiment 50 of tilt divider 30 comprising retainer 55 and a spacer 51, which has a continuous wall 59 and an open center 53. Retainer 55 has a hooked end 57, which can be used as an aid in pulling loop 33' through open center 53, and a slightly deformed section, which serves as a detent for keeping retainer 55 in place with loop 33'. In this arrangement, the length of loop 33' is determined by the length of wall 59 and the diameter 58 of retainer 55.

Figure 10:
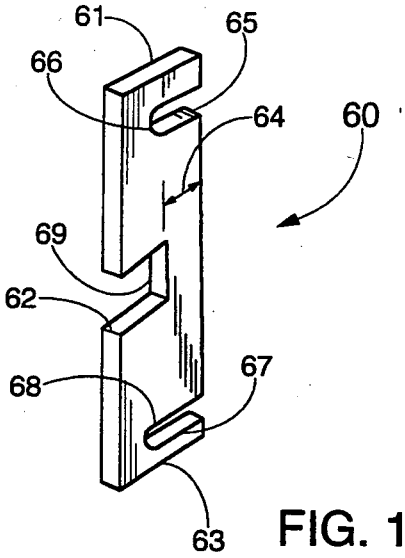
FIG. 10 is a preferred embodiment of a single piece tilt divider.

FIG. 10 shows a third preferred embodiment of the present invention in a form of a simplified, single piece tilt divider 60 which may be cut from sheet material or injection molded. The shape of tilt divider 60 is flat and elongated with notch 62 providing section width 64 at a location more or less central to its length. While notch 62 need not be placed centrally, it is so located here to relieve the user of any concern over the installed orientation of tilt divider 60. Close to first end 61 and second end 63 of tilt divider 60 are retaining slots 65 and 67 respectively, the function of which is later described. It is noted that the depth of slots 65 and 67 is such that they bottom out with roots 66 and 68 in approximate alignment with the bottom 69 of notch 62.

Figure 11:
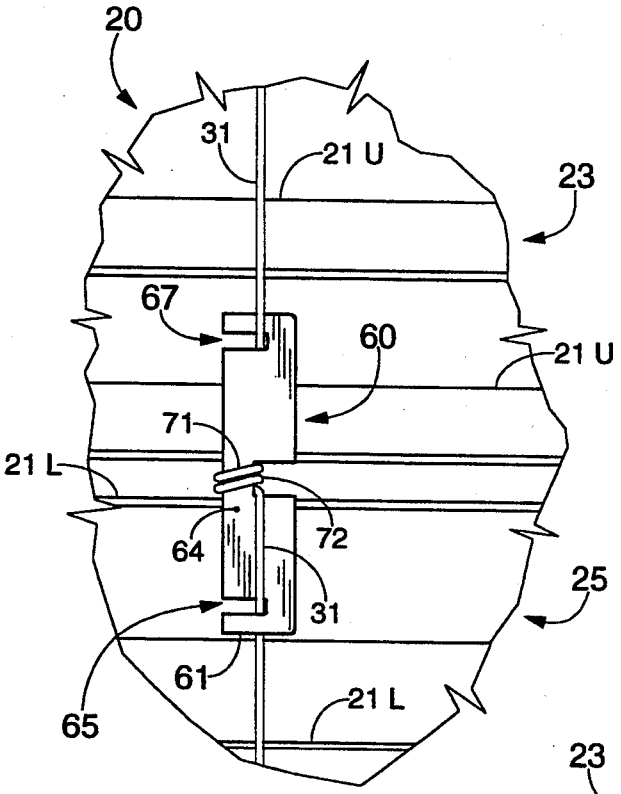
FIG. 11 shows the embodiment of FIG. 10 as installed.

The installation of tilt divider 60 is seen in FIG. 11, where venetian blind 20 of FIG. 1 is shown with tilt divider 60 replacing tilt divider 30 of FIG. 1. Tilt divider 60 is engaged with vertical cord 31" to make loops 71 and 72 around width 64 and then, retaining slots 67 and 65 are hooked onto vertical cord 31" above and below loops 71 and 72 to prevent disengagement thereof. Whether loops 71 and 72 are made in a right or left hand sense is of no concern to the user since retaining slots 65 and 67 are opposed. As shown here, retaining slot 67 opposes disengagement. The effect of loops 71 and 72 is to produce the upward tilt of slats 21L in lower portion 25 relative to slats 21U" in upper portion 23 in the same manner as shown in FIG. 3.

Figure 12:
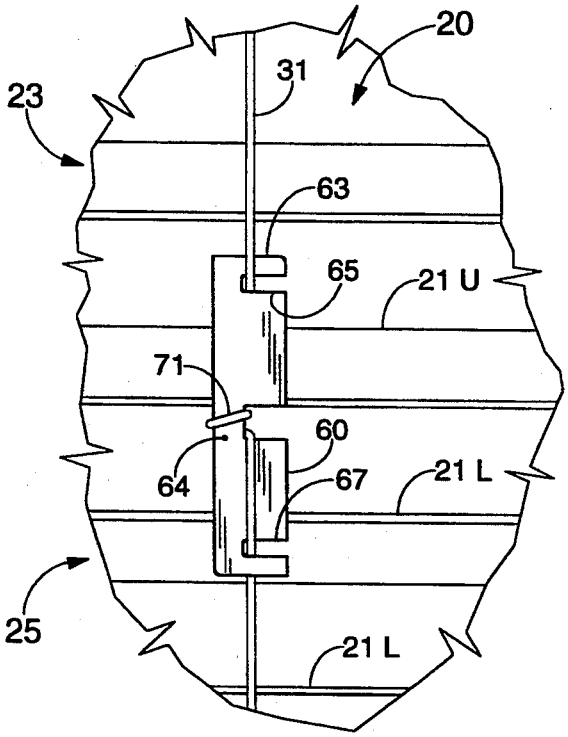
FIG. 12 shows a second installation of the embodiment of FIG. 10.

In FIG. 12, otherwise the same as FIG. 11, tilt divider 60 is engaged with vertical cord 31 with only loop 71 around width 64, providing an intermediate tilt adjustment. The dimension of section width 64 can be varied to provide full relative tilt adjustment with a single loop, or to make three or more steps of adjustment. As a practical matter, the two step adjustment shown in FIGS. 11 & 12, provides adequate variability and is best suited to general usage.

Figure 13:
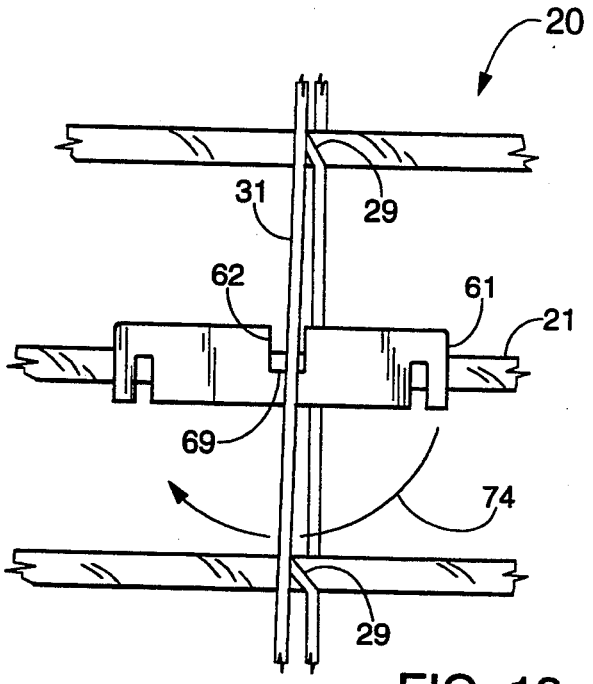
FIG. 13 shows an initial position for the installation.
Figure 14:
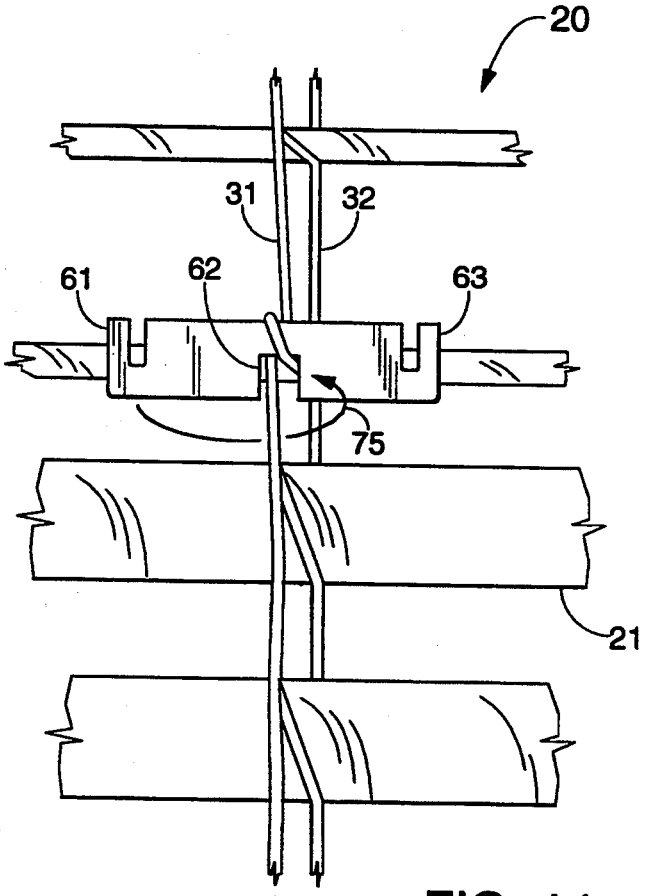
FIG. 14 shows an intermediate position for the installation.

FIG. 13 shows the installation of tilt divider 60 for the results of FIGS. 11 and 12. Tilt divider 60 is placed behind vertical cord 31 with notch bottom 69 close up against a selected slat support cord 29. Then, end 61 is rotated downwardly, through 180° as indicated by arrow 74, and in front of vertical cord 31 while keeping cord 31 in notch 62. This rotation places tilt divider in the position shown in FIG. 14. From this position, rotating end 63 upwardly gives the showing of FIG. 12 when vertical cord 31 is lodged in slots 65 and 67. Alternatively, rotating end 61 around and behind vertical cord 31, as indicated by arrow 75, gives the showing of FIG. 11. Inasmuch as the length of tilt divider 60 from notch 62 to end 61 must pass between vertical cord 31 and outside vertical cord 32, that dimension should not be much greater than the width of slat 21 and should preferably be less.

It is to be understood that the present invention is not limited to the disclosed embodiments, and that the spirit thereof may also be expressed through a rearrangement, modification or substitution of parts.

We claim:

1. Apparatus for altering the tilt angle of a portion of the slats of a venetian blind comprising:

a plurality of tilting slats arranged in a vertical array having upper and lower portions;

two spaced apart tilt control ladders, each having two vertical cord members interconnected by slat support cords uniformly spaced therealong so as to support each slat of said plurality at a discreet elevation;

a spacer having a longitudinal wall of fixed length and an open center;

a retainer with the length thereof supported transversely over said open center and held in place by a loop of one said vertical cord member, at a point between said array upper and lower portions, so that said fixed wall length and a dimension of said retainer cooperate to reduce the spacing between said array portions as determined by said cord member and alter the tilt angle of slats in said lower portion relative to the tilt angle of slats in said upper portion; and positioning means for selectively retaining said loop in a first position or a second position so that the inclination of slats in said lower portion is selectively altered.

2. Apparatus for a venetian blind according to claim 1, and further comprising:

an opening in said wall to facilitate passage of the loop of said cord member through said open center and over said retainer.

3. Apparatus for altering the tilt angle of a portion of the slats of a venetian blind comprising:

a plurality of slats arranged in a plane in a vertical array and having upper and lower portions;

two spaced apart tilt control ladders, each having vertical cord members interconnected by uniformly spaced slat support cords which support each said slat at a discreet elevation;

a tilt divider including an elongate body having a length and a width;

means for engagement of said elongate body with a vertical cord member, between said upper and lower slat array portions, so that rotation of said body about an axis orthogonal to said plane with respect to said cord member makes a loop of cord around the width of said body; and means for catching one end of said elongate body on said vertical cord member so as to restrain said elongate body against counter-rotation and thereby hold said loop.

4. Apparatus for altering the tilt angle of a portion of the slats of a venetian blind according to claim 3 wherein said body holds more than one loop of cord therearound.

5. Apparatus according to claim 3 wherein:

said means for engagement comprises a transverse dimension of said elongate body around which is made said loop of cord, with said rotation being permitted by holding said loop at a dimension less than the width of said slats from an end of said elongate body.

6. Apparatus according to claim 3, wherein:

said means for engagement comprises a notch in said elongate body which holds a loop of said vertical cord, with said rotation being permitted by placement of said notch at a dimension less than the width of said slats from an end of said elongate body.

7. Apparatus for altering the tilt angle of a portion of the slats of a venetian blind according to claim 5 wherein said means for engagement holds more than one said loop of cord around said body.

8. Apparatus for altering the tilt angle of a portion of the slats of a venetian blind according to claim 6 wherein said notch holds more than one loop of cord around said body.

9. Apparatus for altering the tilt angle of a portion of the slats of a venetian blind according to claim 3 wherein said means for engagement does not require a specific direction of rotation of said body with respect to said cord member.

10. Apparatus for altering the tilt angle of a portion of the slats of a venetian blind according to claim 6 wherein said means for engagement does not require a specific direction of rotation of said body with respect to said cord member.

11. Apparatus for altering the tilt angle of a portion of the slats of a venetian blind according to claim 3 wherein said means for engagement does not require a specific direction of rotation of said body with respect to said cord member.

12. Apparatus for altering the tilt angle of a portion of the slats of a venetian blind comprising:

a plurality of slats arranged in a plane in a vertical array array having upper and lower portions;

two spaced apart tilt control ladders, each having vertical cord members interconnected by uniformly spaced slat support cords which support each said slat at a discreet elevation;

a tilt divider including an elongate body having a length and a width;

means for engagement of said elongate body with a vertical cord member, between said upper and lower slat array portions, so that rotation of said body about an axis orthogonal to said plane with respect to said cord member makes a plurality of loops of cord around the width of said body; and means for catching one end of said elongate body on said vertical cord member so as to restrain said elongate body against counter-rotation and thereby hold said loops.

* * * * *